US005556270A

United States Patent [19]

Komine et al.

[11] Patent Number: 5,556,270

[45] Date of Patent: Sep. 17, 1996

[54] BLADE FOR A ROTARY COMPRESSOR

[75] Inventors: Kenji Komine; Wataru Ikeda; Mamoru Egawa; Kastuhiro Shinosawa; Hiroyuki Isegawa; Kazuo Honaga; Yutaka Abe; Tsuneji Kameda; Shinobu Sato, all of Tokyo, Japan

[73] Assignee: Kabushiki Kaisha Toshiba, Kawasaki, Japan

[21] Appl. No.: 405,073

[22] Filed: Mar. 16, 1995

Related U.S. Application Data

[63] Continuation-in-part of Ser. No. 116,975, Sep. 7, 1993, Pat. No. 5,401,149.

[30] Foreign Application Priority Data

| | | | |
|---|---|---|---|
| Sep. 16, 1992 | [JP] | Japan | 04-246074 |
| Feb. 16, 1993 | [JP] | Japan | 05-026358 |
| Aug. 24, 1994 | [JP] | Japan | 6-199167 |

[51] Int. Cl.[6] ..... F01C 21/00

[52] U.S. Cl. ..... 418/179; 501/105

[58] Field of Search ..... 418/63, 179, 248; 501/104, 105

[56] References Cited

U.S. PATENT DOCUMENTS 4,587,225 5/1986 Tsukuma et al. ..... 501/105

FOREIGN PATENT DOCUMENTS 191056 9/1960 Japan .
237828 4/1991 Japan .

*Primary Examiner*—Charles Freay
*Attorney, Agent, or Firm*—Oblon, Spivak, McClelland, Maier, & Neustadt, P.C.

[57] ABSTRACT

A blade for the use of a rotary compressor includes a sintered body composed of 50 to 98.5 wt. % of zirconia, 1 to 49.5 wt. % of alumina and the reminder including 0.5 to 10 wt. % of a stabilizing material. The stabilizing material is comprised of at least one selected from magnesia, calcia, ceria and an oxide of an rare-earth metal and the grain size of the sintered body is less than 3 μm. The zirconia in the sintered body is substantially formed with a tetragonal structure or a mixture of tetragonal and cubic structures.

20 Claims, 2 Drawing Sheets

BLADE FOR A ROTARY COMPRESSOR

This application is a continuation-in-part of Ser. No. 08/116,975 filed Sep. 7, 1993, now U.S. Pat. No. 5,401,149.

FIELD OF THE INVENTION

This invention relates to a slide movable member, and more particularly to a blade member for the use of a rotary compressor.

DESCRIPTION OF THE RELATED ART

A rotary type of a fluid compressor referred to a rotary compressor has a cylinder in which an eccentrically rotatable roller and a reciprocally movable blade member is provided. The blade member is forcibly in contact with the outer surface of the roller member by resilient means in a blade guide and moved in a radial direction in response to the movement of the roller member so that the outer surface of the roller member is kept in contact with the blade member during the rotation of the roller. A space, which is surrounded by the inner surface of the cylinder, the outer surface of the roller and blade members forms a compression chamber in the cylinder. Refrigerant sucked in the chamber is compressed in response to the rotation of the roller member and is discharged outside the cylinder. The blade member which is slided in the blade guide and contacted with the roller member requires a high abrasion resistance.

In recent years, a wide range of air conditioning capacity in an air conditioner has been desired. To meet such desire, an inverter unit is used for continuously driving the rotary compressor of the air conditioner and for expanding the rotational speed of the compressor. The rotational speed of the rotary compressor can be varied, for instance from 1820 r.p.m. to 7200 r.p.m. according as heat load. However, due to the continuous operation of the compressor with expanding the rotational speed, the metal contact occurred between the blade and roller members and between the blade member and the cylinder is increased, and then the wear of the blade and roller members and the cylinder may progress. This results in lowering the compression efficiency of the rotary compressor or leads to a malfunction of the rotary compressor.

Japanese Patent Disclosure Sho 61-36166 discloses a slide member of a rotary compressor, which contains alumina as a base component and an additive of 5 to 30 wt. % zirconia or 5 to 50 wt. % of non-organic fiber materials. The additive enhances the bending strength of the slide member, however the disclosed slide member is not satisfactory with respect to the abrasion resistance, particularly when the compressor uses HFC-R134 refrigerant known as a substitute for R22 refrigerant, which has no chlorine (Cl) in its chemical composition and does not harm the ozone layer.

SUMMARY OF THE INVENTION

Accordingly, it is an object of the present invention to provide an improved blade member for the use of a rotary compressor, which has a high abrasion resistance.

It is another object of the present invention to provide a high abrasion resisting blade for the use of a rotary compressor, which reduces friction of mating members such as a cylinder and a roller member of the rotary compressor.

It is further object of the present invention to provide an improved rotary compressor which is adapted to use HFC 134a refrigerant.

To accomplish the above objects, a blade member for the use of a rotary compressor includes a sintered body which is composed of 50 to 98.5 wt. % of zirconia, 1 to 49.5 wt. % of alumina and the remainder including 0.5 to 10 wt. % of a stabilizing material. The blade member for the use of a rotary compressor may also contain 10 to 49.5 wt. % of alumina. The grain size of the sintered body is less than 3 μm. The stabilizing material is comprised of at least one selected from magnesia, calcia, ceria and an oxide of rare-earth metals. Zirconia in the sintered body is substantially formed with tetragonal structures or the mixture of tetragonal and cubic structures.

BRIEF DESCRIPTION OF THE DRAWINGS

These and other objects and advantages of the present invention will become more apparent and more readily appreciated from the following detailed description of the presently preferred embodiment of the invention, read in conjunction with the accompanying drawings wherein.

DETAILED DESCRIPTION OF THE PREFERRED EMBODIMENT

Figure 1:
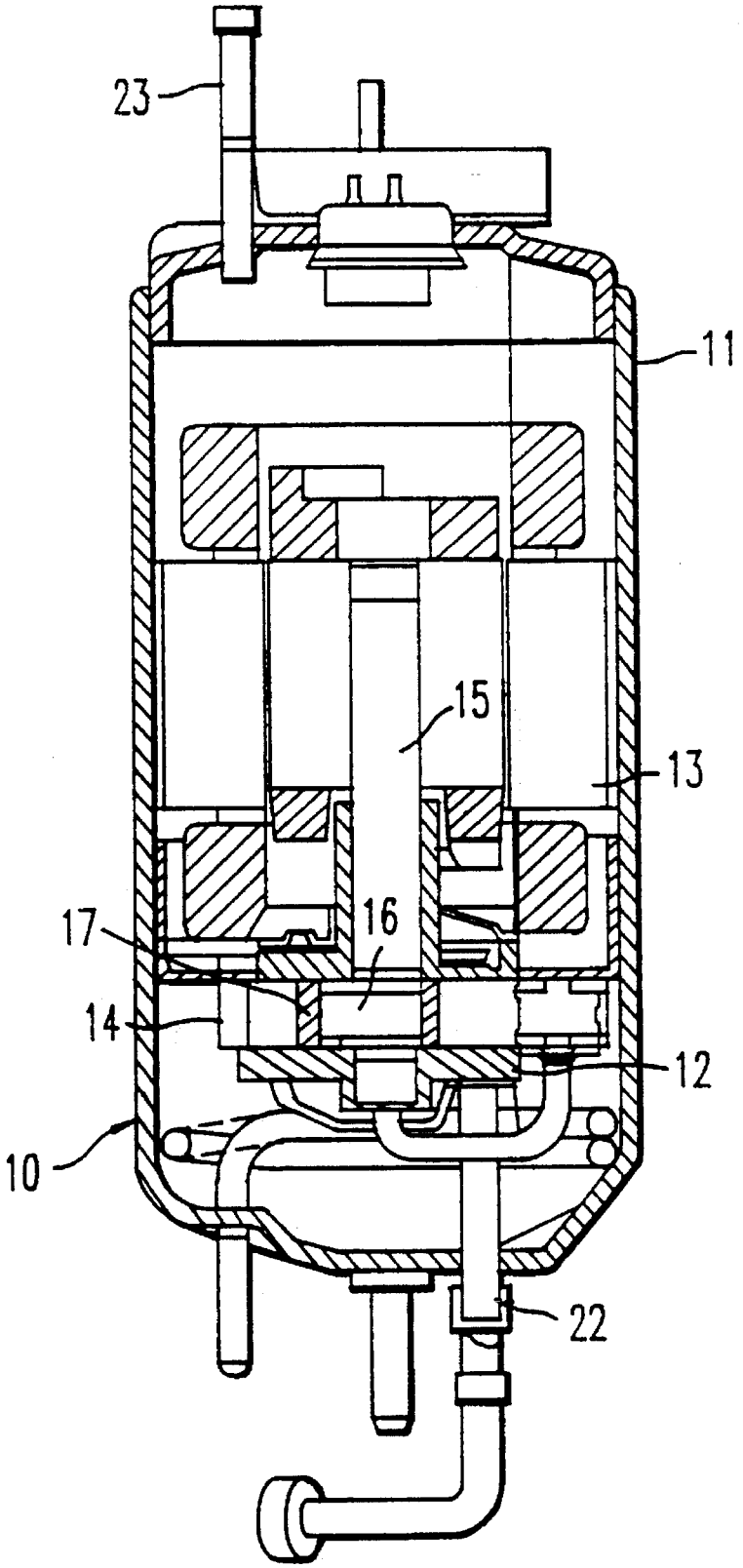
FIG. 1 is a cross sectional view of a rotary compressor.

The preferred embodiment of the present invention will now be described with reference to the accompanying drawings. As shown in FIG. 1, a rotary compressor 10 includes a cylindrical outer casing 11 laterally installed. A rotary compressing mechanism 12 and a motor-driving mechanism 13 are arranged in outer casing 11. Rotary compressing mechanism 12 is driven by motor-driving mechanism 13. Rotary compressing mechanism 12 includes a cylinder 14 in which a rotational shaft 15 is extended. A cam 16 is provided at an end portion of rotary shaft 15 in cylinder 14. Cam 16 has its center off to the rotational center of rotational shaft 15, and a roller member 17 is fixed to the outer wall of cam 16. Thus, roller member 17 is eccentrically rotated in cylinder 14 in response to the rotation of shaft 15.

A blade member 18 is located across cylinder 14 in a radial direction. One end 18*a* of blade member 18 is forcibly in contact with the outer surface of roller member 17 by resilient means 19 disposed at the other end of blade member 18. As clearly shown in FIG. 2, blade member 18 is reciprocally slidable in a blade guide 20 in response to the rotation of roller member 17. A space, which is surrounded by the inner surface of cylinder 14, the outer surface of roller and blade members 17, 18 forms a compression chamber 21. Refrigerant sucked into compression chamber 21 through a suction pipe 22 is compressed in response to the rotation of roller member 17 and is discharged outside cylinder 14. A discharge pipe 23 is connected to outer casing for discharging the compressed refrigerant outside compressor 10.

Making process of blade member 18 for rotary compressor 10 will now be described.

Firstly, a mixture of metal powders containing zirconia ($ZrO_2$), alumina ($Al_2O_3$) and a stabilizer is prepared and dried. A suitable composition of the finish blade member by weight percent is:

| | |
|---|---|
| $ZrO_2$ | 50 to 98.5 wt % |
| $Al_2O_3$ | 1 to 49.5 wt % |
| Stabilizer | 0.5 to 10 wt % |

The mixture is molded to a blade shaped body in a suitable molding process such as injection molding, rubber-press molding or casting. The shaped body is degreased and then heated in a furnace at 1300° C. to 1700° C. for a period of one to three hours in order to obtain a sintered blade body. If necessary, a hot isostatic process referred to as HIP will be applied to the sintered blade body, which is carried out at 1300° C. to 1700° C. in an inert gas atmosphere having a pressure of 10 to 100 MPa. The finished blade body is thus obtained in which tetragonal and cubic zirconia structures are formed. The grain size of the sintered body is less than 3 μm and the bulk density of the sintered body is more than 95%.

Figure 3:
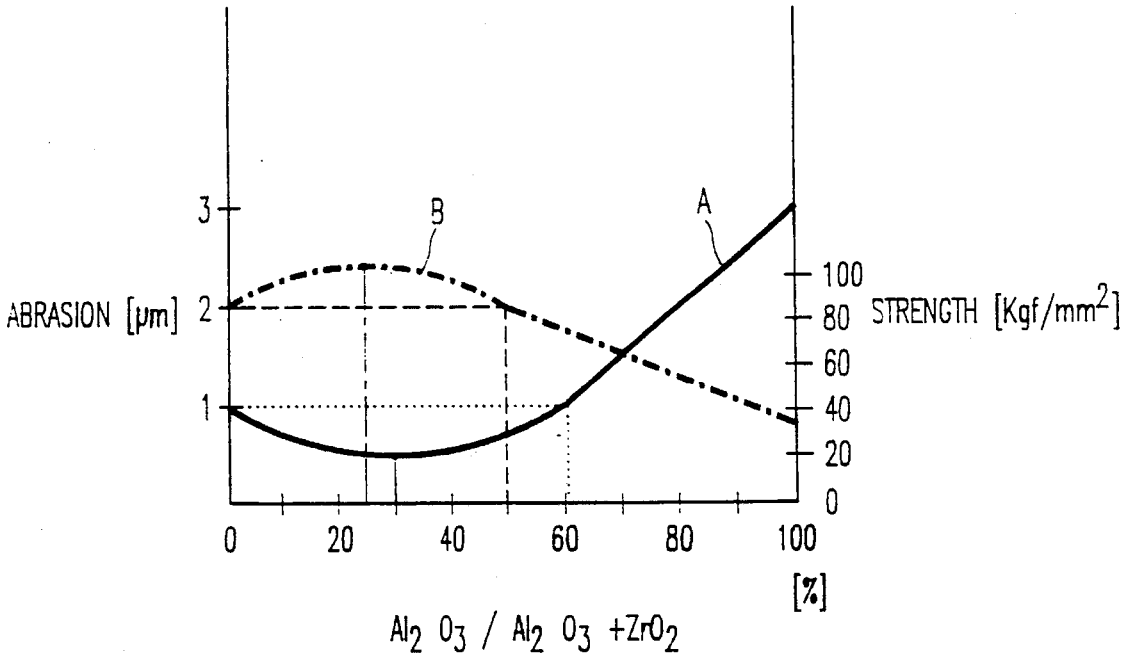
FIG. 3 is a graph showing abrasion and bending strength of the blade member.

Various blade members or workpieces having different mixing ratios of zirconia and alumina were made by the process mentioned above. Each of workpieces was tested for 4000 hours at 120° C. under R22 refrigerant gas pressure of 3 MPa in a rotary compressor. A roller member as a mating member of the workpiece 18 was made of a cast iron alloy containing Cr—Mo—Ni. FIG. 3 was obtained as the test result. The graph A shows the abrasion amount for each workpiece measured after the test, which are varied with the amount of alumina contained in the workplace. According to the graph A, the abrasion becomes the minimum when $Al_2O_3/Al_2O_3+ZrO_2$ is 30 wt. %. It seems that the workpiece containing alumina of 60 wt. % is acceptable for blade member 18 of rotary compressor 10, however the bending strength of the workpiece is relatively low as the graph B shows. The bending strength of the workpieces becomes lower when $Al_2O_3/Al_2O_3+ZrO_2$ exceeds 50 wt. %. As mentioned above, blade member 18 is forcibly kept in contact with roller member 17 by resilient means 19 and it is designed to follow roller member 17 during the operation of compressor 10. However due to the reaction against the force exerted on the end of blade member 18 during the rotation of roller member 17, which is substantially perpendicular to an axis of blade member 18, blade member 18 happens to hop or jump from roller member 17. This jumping causes blade member 18 to crack greatly. Accordingly, preferred bending strength of blade member 18 is chosen to be more than 80 kgf/mm$^2$. In this respect, preferred amount of alumina ($Al_2O_3$) is decided, which is 1 to 49.5 wt. %. Based on this amount of alumina, zirconia ($ZrO_2$) and a stabilizer material are decided to 50 to be 98.5 wt. %, 0.5 to 10 wt. %, respectively. The best selection of alumina weight percent would be between 25 wt. % and 30 wt. % to realize a high abrasion-resistant blade member with the maximum bending strength. According to the present invention, zirconia having tetragonal structures in the blade material is preferable to be at least 10 wt. %. It is further preferable to use the stabilizer comprising of at least one selected from magnesia, calcia, ceria and an oxide of rare-earth metal such as yttria.

Japanese Patent Disclosure Sho 61-36186 discloses an alumina-based blade material containing zirconia as an additive to enhance the bending strength. The bending strength of the blade material containing 30 wt. % zirconia is 60 Kgf/mm$^2$, which is two times larger comparing to the blade material containing 100 wt. % zirconia. Although, there shows no data regarding abrasion of the blade material in the disclosure, the blade material containing 30 wt. % zirconia would render 3 μm abrasion by the mating material if tested for 4000 hours under the similar condition mentioned above. Zirconia thus enhances the bending strength of the blade material and it is acceptable for the use of a conventional compressor intermittently operated with a fixed rotational speed. However the blade material in the disclosure is not satisfactory for the use of a rotary compressor continuously operated with expanding rotational speed.

A conventional blade material such as high speed steel (JIS SKH-51) or nitrided chromium steel is originated for the use of a compressor using R22 refrigerant with ester-type synthetic refrigerating oils. It is expected that a probability of a burn-in caused by the rotational contact with a mating metal part such as the roller member of a compressor using HFC R134 refrigerant is higher than in the compressor using R22 refrigerant because HFC-R134 refrigerant has no chlorine (Cl) in its chemical composition while chlorine in R22 refrigerant serves to protect the burn-in on the other hand. A blade member according to the present invention shows excellent abrasion-resistant as a result of 4000 hour comparative test using HFC-R134 and R22 refrigerants under the similar condition mentioned above. Namely, abrasion of the blade member according to the present invention was within 1 μm while the same of the conventional steel blade member was more than 5 μm.

As shown in the table I hardness of the sintered blade member according to the present invention (herein-after called Alumina-Zirconia Blade) is Vicker hardness Hv 1500, and it is understood the surface of Alumina-Zirconia Blade has hardness higher than that of the conventional nitrided chromium steel (Hv 500). Alumina-Zirconia Blade has a low friction coefficient and a high melting point, which exhibits a high abrasion-resistance. The density of Alumina-Zirconia Blade (6 g/cc) is lower than that of the conventional steel (7.9 g/cc), and Alumina-Zirconia Blade generates less vibrations and noises during the operation of the rotary compressor. The thermal expansion coefficient of Alumina-Zirconia Blade is $9\times10^{-6}$ [1/°C.], which is similar to the thermal expansion coefficient $10\times10^{-6}$[1/°C.] of cast iron or the steel. Accordingly, Alumina-Zirconia Blade is excellent mating part of the roller member or the cylinder made of the cast iron or the steel because the creation of a clearance between the blade and roller members or the blade member and the cylinder is less likely to occur. Compression loss caused by the clearance is then prevented,

TABLE I

| | Vicker Hardness (Hv) | Friction Coefficient | Melting Point [°C.] | Density [g/cc] | Thermal Expansion Coefficient [1/°C.] | Strength [Kgf/mm$^2$] |
|---|---|---|---|---|---|---|
| Alumina-Zirconia Material | 1500 | 0.4 | 2300 | 6.0 | $9.0\times10^{-6}$ | 100 |

TABLE I-continued

| | Vicker Hardness (Hv) | Friction Coefficient | Melting Point [°C.] | Density [g/cc] | Thermal Expansion Coefficient [1/°C.] | Strength [Kgf/mm$^2$] |
|---|---|---|---|---|---|---|
| Nitrided Chromium Steel | 500 | — | — | — | — | — |
| Silicon Nitride | 1400 | 0.8 | 2000 | 3.2 | $3.4 \times 10^{-6}$ | 90 |
| Stabilized Zirconia | 1350 | 0.6 | 2700 | 6.0 | $9.0 \times 10^{-6}$ | 30 |
| Stabilized Alumina | 1800 | 0.8 | 2050 | 3.9 | $8.0 \times 10^{-6}$ | 30 |
| Partially Stabilized Zirconia | 1400 | 0.5 | 2700 | 5.9 | $9.0 \times 10^{-6}$ | 100 |
| Steel | — | — | — | 7.9 | — | — |

Silicon nitride is a high abrasion-resistant material, however its thermal expansion coefficient in relatively low $3.4\times10^{-6}$ [1/°C.] to the mating parts made of the cast iron or the steel, and therefore the blade member made of the silicon nitride is not preferable because of the creation of compression loss when the temperature of the rotary compressor raises. Needless to say, thermal expansion coefficient of the blade member and the roller member or the blade member and the cylinder are preferable to be equaled.

A partially stabilized zirconia (PSZ) has a high hardness surface (Vicker hardness is Hv 1400) and thermal expansion coefficient of $9\times10^{-6}$ [1/°C.] comparable to those of Alumina-Zirconia Blade. However the partially stabilized zirconia generates micro-cracks when it is kept in a high temperature atmosphere of 200° C. for a long time. The micro-cracks lead to destruction of the blade member itself. The micro-cracks are caused by expansion of the volume due to the phase change of zirconia. Alumina-Zirconia Blade, which is a thermally steady material, on the other hand generates no such micro-cracks.

Blade materials require strength in some extent because the jumping happens in the rotary compressor as mentioned above. Alumina-Zirconia Blade has bending strength of 100 [Kgf/mm$^2$], which is higher than those of a fully stabilized zirconia and the fully stabilized alumina (30 [Kgf/mm$^2$]) and is comparable to those of the silicon nitride (90 [Kgf/mm$^2$]) and the partially stabilized zirconia (100 [Kgf/mm$^2$]).

The Vickers hardness, density, and liner thermal expansion coefficient of the alumina-zirconia blade have an allowable value range respectively and are not limited to the values shown in Table I.

As shown in Table II, the usable range of the blade depends on the blade workability and blade abrasion loss. Regarding the blade workability by finish grinding, when the Vickers hardness is Hv 1250 through Hv 1550, the working time is short and the working precision is high, and thus the workability is good. But, when the Vickers hardness exceeds Hv 1650, the base material of the blade hardens too much and the working time becomes longer, and thus the workability is bad. Regarding the abrasion loss of the partner material, when the Vickers hardness is Hv 1550 or smaller, the loss is small, but when the Vickers hardness exceeds Hv 1650, the blade hardens too much and the loss increases.

TABLE II

| | Alumina-Zirconia-Blade | | | | | | |
|---|---|---|---|---|---|---|---|
| Vickers hardness | 1250 | 1350 | 1450 | 1500 | 1550 | 1650 | 1750 |
| Workability | ⊙ | ⊙ | ⊙ | ⊙ | ○ | Δ | X |
| Damage of partner material | ⊙ | ⊙ | ⊙ | ⊙ | ○ | Δ | X |
| Abrasion loss of blade | Δ | ○ | ⊙ | ⊙ | ⊙ | ⊙ | ⊙ |

⊙ : Practically good
○ : have no practical problems
Δ: have practical problems
X: practically no good Regarding the abrasion loss of the blade, when the Vickers hardness is Hv 1250 or smaller, the hardness of the blade is not enough and the abrasion loss is big, but when the Vickers hardness is Hv 1350 or greater, the loss can be reduced.

Therefore, considering the workability of the blade, the abrasion loss of the mating material, and the abrasion loss of the blade, it is found that the hardness of the blade is best when the Vickers hardness is Hv 1350 through Hv 1550.

From Table III, it is understood that with the alumina-zirconia blade, compared to the blade made of iron whose density is 7.9, the starting torque is reduced, the maximum number of rotations increases, and the operation efficiency of the compressor improves, and also its lighter weight reduces vibration and noise.

To reduce the abrasion loss of the blade, the Vickers hardness must be Hv 1350 through Hv 1550, and the density of alumina-zirconia must be 4.8 through 6.0.

TABLE III

| | Iron | Alumina-Zirconia Blade | | | | |
|---|---|---|---|---|---|---|
| Density | 7.9 | 4.6 | 4.8 | 5.3 | 6.0 | 7.0 |
| Vickers hardness | 1000 | 1250 | 1350 | 1450 | 1550 | 1650 |
| Compression efficiency | X | Δ | ○ | ⊙ | ○ | Δ |
| Abrasion of blade | Δ | ○ | ⊙ | ⊙ | ○ | Δ |
| Vibration, noise | ⊙ | ⊙ | ⊙ | ⊙ | ○ | Δ |

⊙ : Practically good
○ : have no practical problems
Δ: have practical problems
X: practically no good Therefore, when the Vickers hardness is set to Hv 1350 through Hv 1550 and, at the same time, the density of alumina-zirconia is set to 4.8 through 6.0, it is made possible to reduce the abrasion loss and, at the same time, to improve the operation efficiency of the compressor and to reduce vibration and noise.

From Table IV showing the relationship among the oil retentiveness, abrasion loss, and deformation degree of the blade, it is understood that when the diameter of small holes (called pores) formed on the surface of the blade is 1 μm or less, no blade deformation occurs and the abrasion loss of the blade is reduced, but the oil retentiveness of the blade is not satisfactory. So, it is predicted that, during high-speed operation under high load, the lubricating oil becomes difficult to stay at the sliding portion, causing seizure or damage to the blade.

When the diameter of the pores exceeds 100 μm, the oil retentiveness of the blade is good, but the abrasion loss of the blade begins increasing. When the diameter of the pores exceeds 200 μm, the blade deformation becomes large, and long operation causes defect or damage to the blade.

TABLE IV

| | Alumina-Zirconia Blade | | | | | | |
|---|---|---|---|---|---|---|---|
| Diameter of pore | less than 0.5 | 0.5 | 1 | 50 | 100 | 200 | 300 |
| Oil retentiveness | X | Δ | ○ | ◎ | ◎ | ◎ | ◎ |
| Abrasion of blade | Δ | ○ | ◎ | ◎ | ◎ | Δ | X |
| Deformation of blade | ◎ | ◎ | ◎ | ◎ | ◎ | ○ | Δ |

◎ : Practically good
○ : have no practical problems
Δ: have practical problems
X: practically no good Therefore, for the blade having pores of 1 μm through 100 μm in diameter, the oil retentiveness is good and the true surface in contact is not too small, and so the abrasion loss of the partner material and the blade can be reduced, enabling high-speed operation under high load.

When the Vickers hardness is set to Hv 1350 through Hv 1550, higher abrasion resistance can be obtained in a wide frequency band from low frequency to high frequency.

As seen from table V showing the degree of leak of the cooling media in the compression process which occurs from the clearance between the blade and blade groove, when the linear thermal expansion coefficient is 8.0 or smaller, the leak lowers the discharge pressure, causing the compression efficiency to become lower.

TABLE V

| | Alumina-Zirconia-Blade | | | | |
|---|---|---|---|---|---|
| Linear thermal expansion coefficient | 7.5 | 8.0 | 8.5 | 9.0 | 9.4 |
| | | ($\times 10^{-4}$ [1/°C. 3]) | | | |
| Leak of refrigerant | Δ | Δ | ○ | ◎ | ◎ |

◎ : Practically good
○ : have no practical problems
Δ: have practical problems
X: practically no good When the linear thermal expansion coefficient is $8.5\times10^{-6}$ through $9.4\times10^{-6}$ [1/°C.], leak of refrigerant is difficult to occur and so the discharge pressure does not lower, enabling the compression efficiency to be stabilized.

Especially, when the liner thermal expansion coefficient is $9.0\times10^{-6}$ [1/°C.], it is very close to that of the metallic material and so even when the blade is combined with the cylinder or roller made of cast iron or steel, it is unlikely that the compression loss is caused by the increase of the clearance due to the difference of the linear thermal expansion coefficients between the materials.

The change of the thermal conductivity is related to the blade overheat, blade abrasion, the deterioration of the refrigerator oil. As shown in the Table VI, when the thermal conductivity is 0.005, there is no practical problem on the deterioration of the refrigerator oil, but the blade becomes easy to be overheated, causing more abrasion loss. When the thermal conductivity is 0.003, the blade becomes easier to be overheated, causing a lot more abrasion loss, and there is a practical problem on the deterioration of the refrigerator oil.

TABLE VI

| | Alumina-Zirconia Blade | | | |
|---|---|---|---|---|
| Thermal conductivity | 0.003 | 0.005 | 0.01 | 0.015 |
| Overheat of blade | X | Δ | ○ | ◎ |
| Abrasion of blade | X | Δ | ○ | ◎ |
| Deterioration of oil | Δ | ○ | ◎ | ◎ |

◎ : Practically good
○ : have no practical problems
Δ: have practical problems
X: practically no good When the thermal conductivity is 0.010 through 0.015, the blade overheat becomes lesser and the deterioration of the refrigerator oil becomes lesser. This reduces the blade abrasion loss and prevents the blade seizure even when the cooling media HFC is used, enabling continuous high-speed operation under high load.

Especially, when the thermal conductivity is 0.015, the minimum blade overheat, blade abrasion, and deterioration of the refrigerator oil are achieved.

Transformation of the tetragonal structure (t phase) to monoclinic structure (m phase) occurs during the use of the blade. When the transformation quantity of the zirconia crystal from t phase to m phase exceeds 50%, a big internal stress occurs to cause cracking. When the transformation quantity is 50% or less, the internal stress due to volume change at the time of transformation is small and no cracking occurs. (Table VII)

TABLE VII

| | Alumina-Zirconia-Blade | | | | | |
|---|---|---|---|---|---|---|
| Transformation quantity | 10 | 20 | 30 | 40 | 50 | 60 |
| Cracking | ◎ | ◎ | ◎ | ◎ | ○ | Δ |

◎ : Practically good
○ : have no practical problems
Δ: have practical problems
X: practically no good When the HIP processing is done for the blade, its internal defects can be reduced to improve the blade rigidity, enabling the blade to be smaller and thinner. When the blade is so constructed as to let the transformation quantity be 50% or less, no cracking occurs. As described above, the characteristic values such as blade hardness, linear thermal expansion coefficient, thermal conductivity, density, pore diameter and phase transformation are set in such a manner that blade noise, blade workability, blade clearance, blade oil retentiveness, abrasion of the mating material, blade crack, blade overheat, and leak of the cooling media do not affect the performance of the compressor even under the following recent harsh operation condition:

long period of continuous operation, and the increasing difference between the maximum output and the minimum output, and HFC refrigerant which does not contain chlorine, such as R134a, is used.

Accordingly, highly reliable compressors can be provided.

Figure 2:
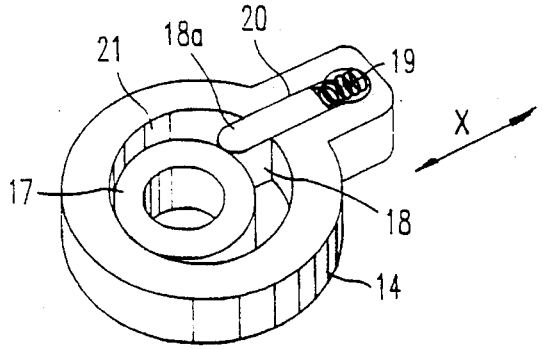
FIG. 2 is an enlarged perspective view of a cylinder and a blade member of the rotary compressor shown in FIG. 1.

Further, in such a rotary compressor, to prevent leak of the refrigerant gas from the cylinder chamber to the sucking chamber at the sliding portion between the blade and the roller, the blade 18 can be ground at a right angle against the blade tip sliding direction X, as shown in FIG. 2.

When grinding is not done in such a manner, a grinding crack is formed extending from the blade compression chamber to the blade sucking chamber via the blade tip, and so the refrigerant gas could leak from the cylinder compression chamber to the cylinder sucking chamber through the grinding crack. But, when grinding is done at a right angle against the blade tip sliding direction, no grinding crack is formed extending from the blade compression chamber to the blade sucking chamber, and so the refrigerant gas can be securely cut off by the blade tip.

When the roller or cylinder (mating material of the blade) is made of alloy cast iron containing Cr-Mo-Ni, and the lubricant oil is 4-value ester synthetic oil, the abrasion loss of the blade, roller, and cylinder can be reduced to 1 μm or less.

In summary, according to the present invention it is possible to obtain an excellent blade member having a high abrasion-resistance, a high strength and thermally steady.

Various modifications will become possible for those skilled in the art receiving the teachings of the present disclosure without departing from the scope thereof. Such modifications are intended to be covered by the claims.

What is claimed is:

1. A blade member for a rotary compressor, comprising a sintered body which comprises:

50 to 98.5 wt. % of zirconia;

10 to 49.5 wt. % of alumina; and 0.5 to 10 wt. % of a stabilizing material, wherein the stabilizing material comprises at least one member selected from the group consisting of magnesia, calcia, ceria and an oxide of a rare-earth metal and, said blade member has a Vickers hardness Hv of 1350 to 1550.

2. A blade member for a rotary compressor, comprising a sintered body which comprises:

50 to 98.5 wt. % of zirconia;

1 to 49.5 wt. % of alumina; and 0.5 to 10 wt. % of a stabilizing material, wherein the sintered body has a grain size of less than 3 μm and, said blade member has a Vickers hardness Hv of 1350 to 1550.

3. A blade member according to claim 1, wherein the sintered body has a grain size of less than 3 μm.

4. A blade member according to claim 1, wherein the zirconia is substantially formed with a tetragonal structure or a mixture of cubic and tetragonal structures.

5. A blade member according to claim 2, wherein the zirconia is substantially formed with a tetragonal structure or a mixture of cubic and tetragonal structures.

6. A blade member according to claim 3, wherein the zirconia is substantially formed with a tetragonal structure or a mixture of cubic and tetragonal structures.

7. A blade member according to claim 1, wherein a surface of said blade member has a plurality of pores formed thereon, and the diameter of said pores is 1 to 100 μm.

8. A blade member according to claim 4, wherein less than 50% of said zirconia can transform from the tetragonal structure to a monoclinic structure.

9. A blade member according to claim 5, wherein less than 50% of said zirconia can transform from the tetragonal structure to a monoclinic structure.

10. A blade member according to claim 6, wherein less than 50% of said zirconia can transform from the tetragonal structure to a monoclinic structure.

11. A rotary compressor for compressing refrigerant, comprising:

a cylinder;

a roller eccentrically rotatable in the cylinder;

a blade guide; and a blade member reciprocally movable in said blade guide and forcibly contacting the roller, wherein the blade member comprises a sintered body which comprises 50 to 98.5 wt. % of zirconia;

10 to 49.5 wt. % of alumina; and 0.5 to 10 wt. % of a stabilizing material, wherein the stabilizing material comprises at least one member selected from the group consisting of magnesia, calcia, ceria and an oxide of a rare-earth metal and, said blade member has a Vickers hardness Hv of 1350 to 1550.

12. A rotary compressor for compressing refrigerant, comprising:

a cylinder;

a roller eccentrically rotatable in the cylinder;

a blade guide; and a blade member reciprocally movable in said blade guide and forcibly contacting the roller, wherein the blade member comprises a sintered body which comprises 50 to 98.5 wt. % of zirconia;

10 to 49.5 wt. % of alumina; and 0.5 to 10 wt. % of a stabilizing material, wherein the sintered body has a grain size of less than 3 μm and, said blade member has a Vickers hardness Hv of 1350 to 1550.

13. A rotary compressor according to claim 11, wherein the sintered body has a grain size of less than 3 μm.

14. A rotary compressor according to claim 11, wherein the zirconia is substantially formed with a tetragonal structure or a mixture of cubic and tetragonal structures.

15. A rotary compressor according to claim 12, wherein the zirconia is substantially formed with a tetragonal structure or a mixture of cubic and tetragonal structures.

16. A rotary compressor according to claim 13, wherein the zirconia is substantially formed with a tetragonal structure or a mixture of cubic and tetragonal structures.

17. A rotary compressor according to claim 11, further comprising an ester type synthetic refrigerating oil.

18. A rotary compressor according to claim 12, further comprising an ester type synthetic refrigerating oil.

19. A rotary compressor according to claim 11, wherein a surface of said blade member has a plurality of pores formed thereon, and the diameter of said pores is 1 to 100 μm.

20. A rotary compressor according to claim 14, wherein less than 50% of said zirconia can transform from the tetragonal structure to a monoclinic structure.

* * * * *

UNITED STATES PATENT AND TRADEMARK OFFICE

CERTIFICATE OF CORRECTION

PATENT NO. : 5,556,270

DATED : September 17, 1996

INVENTOR(S) : Kenji KOMINE, et al.

It is certified that error appears in the above-indentified patent and that said Letters Patent is hereby corrected as shown below:

On the title page, Item [63], the Related U.S. Application Data should read:

-- [63] Continuation-in-part of Ser. No. 116,975, Sep. 7, 1993, Abandoned. --

Signed and Sealed this

Seventeenth Day of December, 1996

*Attest:*

*Attesting Officer*

Bruce Lehman

BRUCE LEHMAN

*Commissioner of Patents and Trademarks*